US007393229B2

(12) United States Patent
Yoshida et al.

(10) Patent No.: US 7,393,229 B2
(45) Date of Patent: Jul. 1, 2008

(54) CONNECTING MECHANISM FOR A CONNECTOR

(75) Inventors: Haruki Yoshida, Shizuoka (JP); Yoshitaka Ito, Shizuoka (JP); Sumito Atsumi, Shizuoka (JP); Hideki Honma, Tokyo (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/893,862

(22) Filed: Aug. 17, 2007

(65) Prior Publication Data

US 2008/0057766 A1 Mar. 6, 2008

(30) Foreign Application Priority Data

Aug. 23, 2006 (JP) ..... 2006-226588

(51) Int. Cl.
*H01R 13/64* (2006.01)

(52) U.S. Cl. ..... 439/247

(58) Field of Classification Search ..... 439/246–248
See application file for complete search history.

(56) References Cited

U.S. PATENT DOCUMENTS 6,364,681 B1 * 4/2002 Watanabe ..... 439/335
6,848,925 B2 * 2/2005 Nishide ..... 439/247
2002/0039852 A1 * 4/2002 Scheunpflug et al. ..... 439/247

FOREIGN PATENT DOCUMENTS

JP 2003-187909 7/2003

* cited by examiner

*Primary Examiner*—Tho D Ta
(74) *Attorney, Agent, or Firm*—Edwards Angell Palmer & Dodge LLP

(57) ABSTRACT

A connecting mechanism for a connector, which can align the connector in a rotating direction and smoothly align the connector for fitting with the mating connector, has a bracket, a holder, a connector and a plate. The bracket has a receiving body receiving the holder, and receives the holder in a receiving hole arranged in the receiving body. The receiving hole has an abut rib projecting from an inner surface in a radial direction. The holder receives the connector 4 and has an elastically deformable first positioning arm. When the holder is received in the receiving hole and fixed in the receiving body with the plate, the abut rib abuts on the first positioning arm, and the holder is aligned in a rotating direction about the receiving body.

12 Claims, 8 Drawing Sheets

CONNECTING MECHANISM FOR A CONNECTOR

The priority application Number Japan Patent Application No. 2006-226588 upon which this patent application is based is hereby incorporated by reference.

BACKGROUND OF THE INVENTION

1. Field of the Invention

The present invention relates to the connecting mechanism for a connector to be used in connection of an electric wire.

2. Description of the Related Art

In a headrest of a vehicle as a mobile object, there is mounted various electronic equipment, for example a monitor and a whiplash preventing device for preventing a whiplash at a time of a crash. Various connecting mechanisms for a connector are used to provide a desired electric power and signal to the electronic device mounted to the head rest.

Heretofore, for improving work operation for assembling the electronic device, a connecting mechanism of a connector as an above mentioned connecting mechanism for a connector is proposed (see patent document 1). The connecting mechanism is for that a connector for electronic equipment in a vehicle body and a mating connector of electronic equipment to be mounted on the vehicle body are fixed in each desired position of the vehicle body, and, when the electronic equipment in the vehicle body and the electronic equipment to be mounted on the vehicle body are connected, the connecting mechanism for a connector makes the connector and the mating connector.

The connecting mechanism for a connector shown in patent document 1 has a stationary holder, a moving holder, a movable member, a supporting member and a support device. The stationary holder is fixed on a door inner panel of the vehicle body, therewith formed in one piece with the connector. The moving holder is formed in one piece with the mating connector fitting in the connector, therewith mounted movably on a door trim. The movable member is mounted on the moving holder. The supporting member supports the movable member and is fixed on the door trim. The support device includes an elastic member mounted between the movable member and the supporting member.

The above mentioned connecting mechanism for a connector arranges the elastic member between the movable member and the supporting member. Therewith, the connecting mechanism is assembled so as to mount the movable member allowable to move perpendicularly against an axial direction of the moving holder, and to tilt freely the movable axial direction of the moving holder. The movable member is mounted in the moving holder. To be supported by the support member, the moving holder can move perpendicularly against the axial direction, and the movable axial direction can be tilted freely, so that the movable axis of the moving holder is aligned to the stationary axis of the stationary holder. Thereby, the connector of the stationary holder and the mating connector of the moving holder are aligned and fit.

The connecting mechanism for a connector assembled in this way connects the electronic equipment in the vehicle body and the electronic equipment to be mounted in the vehicle body through the connector and the mating connector combined to each other. Therewith, a desired power and signal are sent to the electronic equipment to be mounted in the vehicle body.

Patent documents 1:

Japan published patent application 2003-187909

SUMMARY OF THE INVENTION

Objects to be Solved

The moving holder of the connecting mechanism for a connector shown in the patent documents 1 can move freely in a direction perpendicular to the movable axial direction of the movable member and the movable axial can be tilted freely by the support device. Therewith, by aligning the movable axis of the moving holder and the stationary axis of a stationary holder, the connector and the mating connector can be aligned. Also, when the connector and the mating connector are disconnected by the elastic member of the support device, the moving holder, that is, the mating connector can return in a default position. For this reason, the movable axis is tilted so as to fit an angle of the stationary axis, and aligned with the stationary axis of the connector in the direction perpendicular to the movable axis, so that there is no freedom of a rotational direction of the connector and the connector cannot be aligned smoothly. In addition, the connecting mechanism for a connector should have a complex structure for aligning the mating connector against the connector, and for moving the mating connector back to the default position after disconnecting. Thereby, a number of parts and steps of process are increasing.

Therefore, an object of the present invention is to provide a connecting mechanism for a connector, which can be aligned in a rotational direction of the connector for aligning the connector with the mating connector smoothly when connecting, and simplify a structure for aligning of the connector, and reduce a number of parts and the steps of process.

How to Attain the Object of the Present Invention

According to a first aspect of the present invention, a connecting mechanism for a connector has a holder receiving a connector inside thereof and holding the connector, and a receiving member receiving the holder inside thereof and holding the holder, and a fixing member mounted on the receiving member and fixing the holder. An inner diameter of the receiving member is formed larger than an outer diameter of the holder. The receiving member includes a receiving hole having a space between the holder and the receiving member when receiving the holder, and an abut rib projecting from an inner surface of the receiving hole into a radial direction. The holder has a first positioning arm, which positions the holder in a rotating direction around an axis of the holder with respect to the receiving member by rotating the holder around the axis in the receiving hole so as to make the first positioning arm abut on the abut rib and press the first positioning arm on the abut rib when the holder is received in the receiving hole and mounted in the receiving member.

According to a second aspect of the present invention, as mentioned above, the first positioning arm projects from an outer surface of the holder in an outward direction to be elastically deformable, and is arranged in a pair. When the holder is rotated in one rotating direction around the axis in the receiving hole, one of the pair of first positioning arms abuts on the abut rib. Furthermore, when rotating in the other direction opposite to the one direction, the other of the pair of first positioning arms abuts on the abut rib.

According to a third aspect of the present invention, as mentioned above, the holder has a second positioning arm, which positions the holder with respect to the receiving member in a radial direction of the receiving hole by abutting on the inner surface of the receiving hole and pressing the inner surface in the radial direction when the holder is received in the receiving hole and mounted to the receiving member.

According to a fourth aspect of the present invention, as mentioned above, the second positioning arm projects from the outer surface of the holder in the outward direction and is arranged in plurality. Also the second positioning arms are arranged with a space along the outer surface and formed to be elastically deformable in the radial direction. When the holder moves in the radial direction in the receiving hole, the plural second positioning arms abut on an inner surface of the receiving hole.

According to a fifth aspect of the present invention, as mentioned above, the receiving member has a control rib projecting from the inner surface of the receiving hole and corresponding to the abut rib. The holder has a limiter controlling a rotation angle of the holder around the axis by abutting on the control rib when the holder is rotated a prescribed angle in the rotating direction around the axis of the holder in the receiving hole.

According to a first aspect of the present invention, the holder has the first positioning arm, which positions the holder in a rotating direction around an axis of the holder with respect to the receiving member by rotating the holder around the axis in the receiving hole so as to make the first positioning arm abut on the abut rib and press the first positioning arm on the abut rib when the holder is received in the receiving hole and mounted in the receiving member. Accordingly, the holder can be set in position with respect to the rotation direction in the receiving hole.

According to a second aspect of the present invention, when the holder is rotated in the one rotating direction around the axis in the receiving hole, the one of the pair of first positioning arms formed elastically deformable abuts on the abut rib. When the holder is rotated in the other direction, which is in the opposite direction to the one direction, the other of the pair of first positioning arms abuts on the abut rib. Consequently, a position of the holder is set in the directions of rotation of the one direction or the other direction which is in the opposite direction to the one direction in the receiving hole of the receiving member, therewith the holder can be aligned in the rotation direction.

According to a third aspect of the present invention, the holder has a second positioning arm, which positions the holder with respect to the receiving member in a radial direction of the receiving hole by abutting on the inner surface of the receiving hole and pressing the inner surface in the radial direction when the holder is received in the receiving hole and mounted to the receiving member. Therefore, the holder can be positioned in the center of the receiving hole.

According to a fourth aspect of the present invention, when the holder is moved in the radial direction, the plural second positioning arms formed elastically deformable abut on the inner surface of the receiving hole. Thereby the holder can be aligned in the radial direction in the receiving hole.

According to a fifth aspect of the present invention, holder has the limiter controlling the rotation angle of the holder around the axis by abutting on the control rib when the holder is rotated a prescribed angle in the rotating direction around the axis of the holder in the receiving hole. Therefore, a movement in the rotation direction of the holder can be limited within a predetermined angle required for alignment and an unnecessary rotation of the holder can be limited, thereby the holder can be aligned smoothly.

EFFECT OF THE INVENTION

According to the invention, the holder can be positioned in the receiving hole of the receiving member in the rotation direction. A connector, which is received and held by the holder, can be positioned in the rotation direction. Thereby, the connector can be fit smoothly with a mating connector inserted in the holder. In addition, the holder includes the first positioning arm, thereby a number of parts can be reduced and the steps of process can be limited.

According to the invention, the holder can be positioned in the receiving hole of the receiving member in the rotation both of one direction and the other direction opposite to the one direction. The holder can be aligned in the rotation direction. The connector, which is received and held in the holder, can be aligned in the rotation direction. Thereby, the connector can be aligned with the mating connector smoothly when fitting. Furthermore, parts for aligning can be reduced, and the steps of process can be limited.

According to the invention, the holder can be positioned in the center of the receiving hole of the receiving member. The connector, which the holder receives and holds, can be positioned in the center of the receiving hole. The connector can be fit smoothly with the mating connector inserted in the holder. Furthermore, the holder includes the second positioning arm, thereby a number of parts can be reduced, and the steps of process can be limited.

According to the invention, the holder can be aligned in the radial direction in the receiving hole. The connector, which the holder receives and holds, can be aligned in the radial direction. Thereby, the mating connector can be smoothly aligned with the connector when fitting. Furthermore, parts for aligning can be reduced, and the steps of process can be limited.

According to the invention, the unnecessary rotation of the holder can be limited by controlling motion in the rotation direction of the holder in the necessary prescribed angle. Thereby, smooth alignment can be performed. The connector can be securely aligned with the other connector, and the connector and the mating connector can be fit securely.

The above and other objects and features of this invention will become more apparent from the following description taken in conjunction with the accompanying drawings.

DESCRIPTION OF THE PREFERRED EMBODIMENTS

A connecting mechanism for a connector (connecting mechanism) according to one embodiment of the present invention is explained by referring to drawings. A connecting mechanism 1 as shown in FIG. 1 is used to transmit a required electric power and a signal to various electronic equipment, such as a monitor mounted in headrest of a vehicle and a whiplash protecting device.

Figure 1:
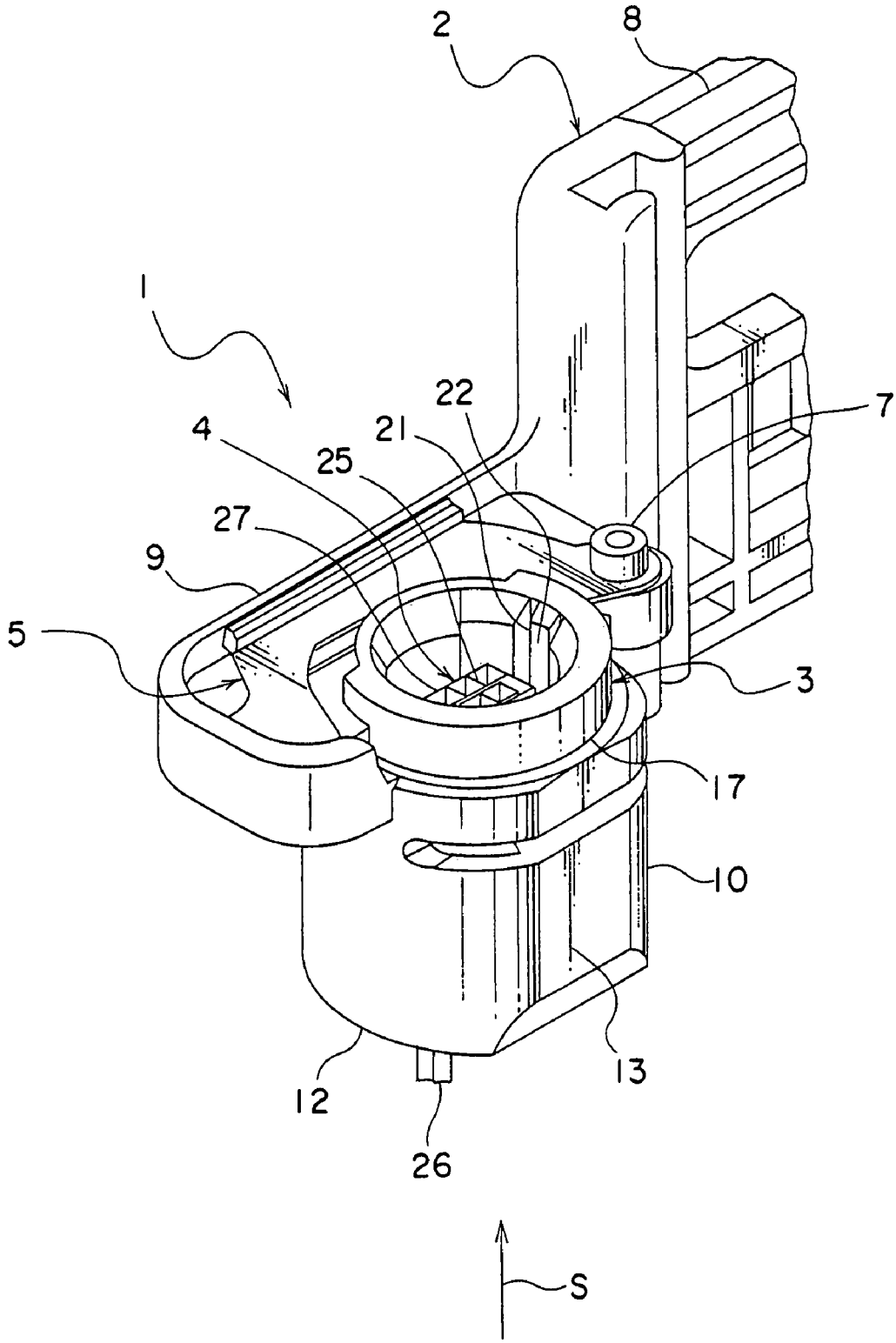
FIG. 1 is a perspective view of an embodiment of a connecting mechanism for a connector according to the present invention.
Figure 2:
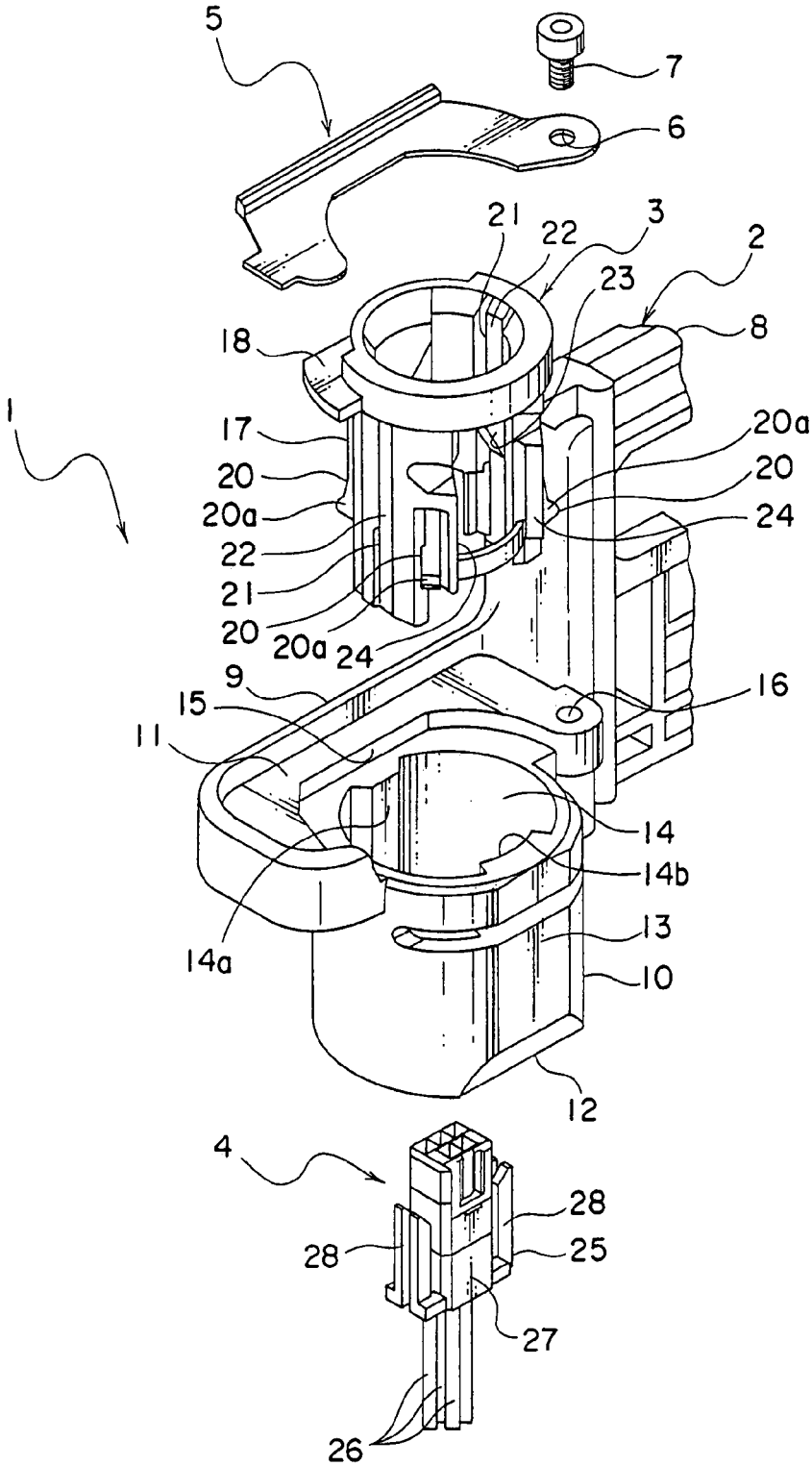
FIG. 2 is an exploded perspective view of the connecting mechanism for a connector of FIG. 1.

As shown in FIG. 1 and FIG. 2, the connecting mechanism 1 has a bracket 2, a holder 3, a connector 4, a plate 5 as a fixing member, and a bolt.

Figure 5:
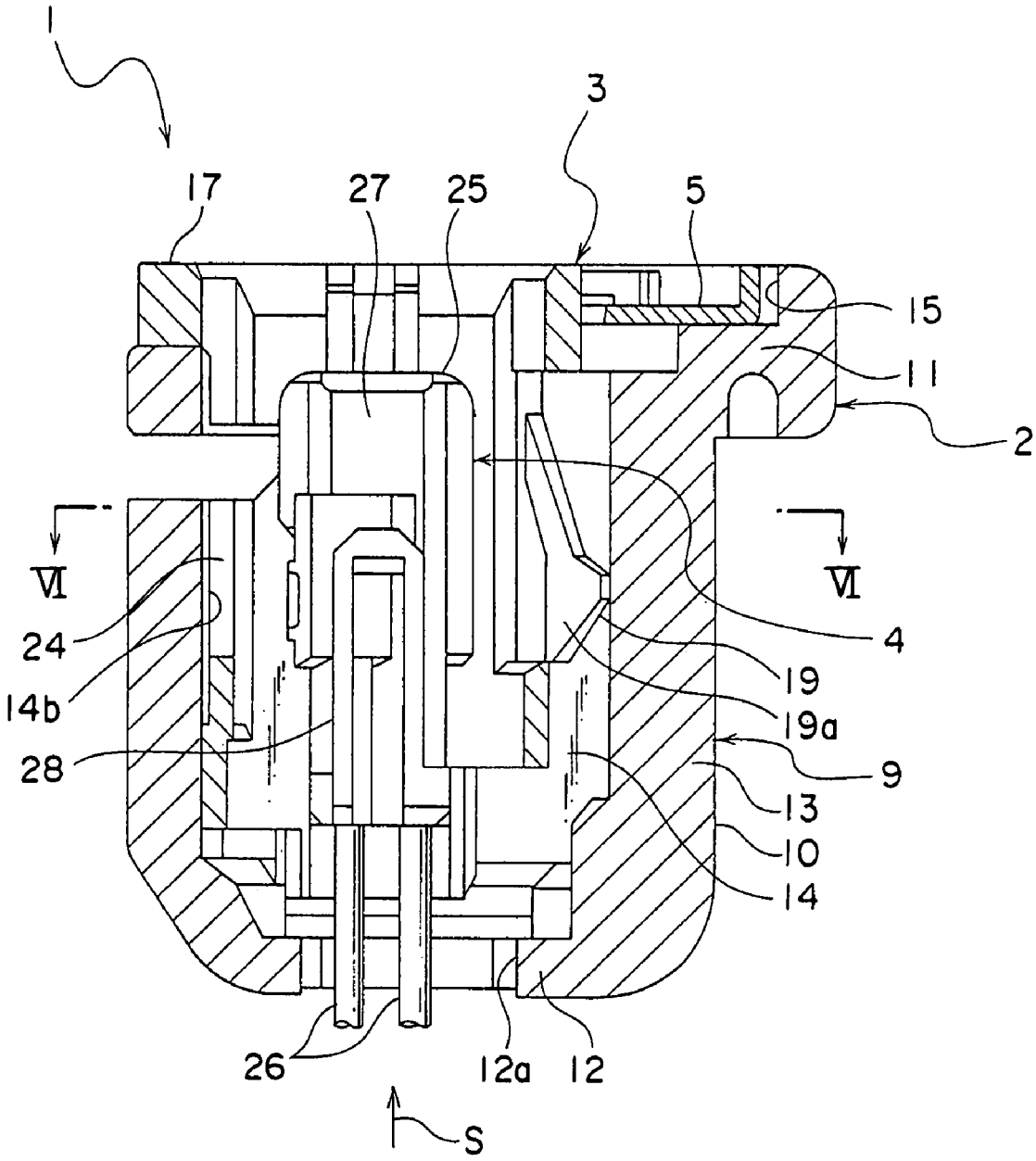
FIG. 5 is a sectional view taken along the line V-V in FIG. 3.
Figure 6:
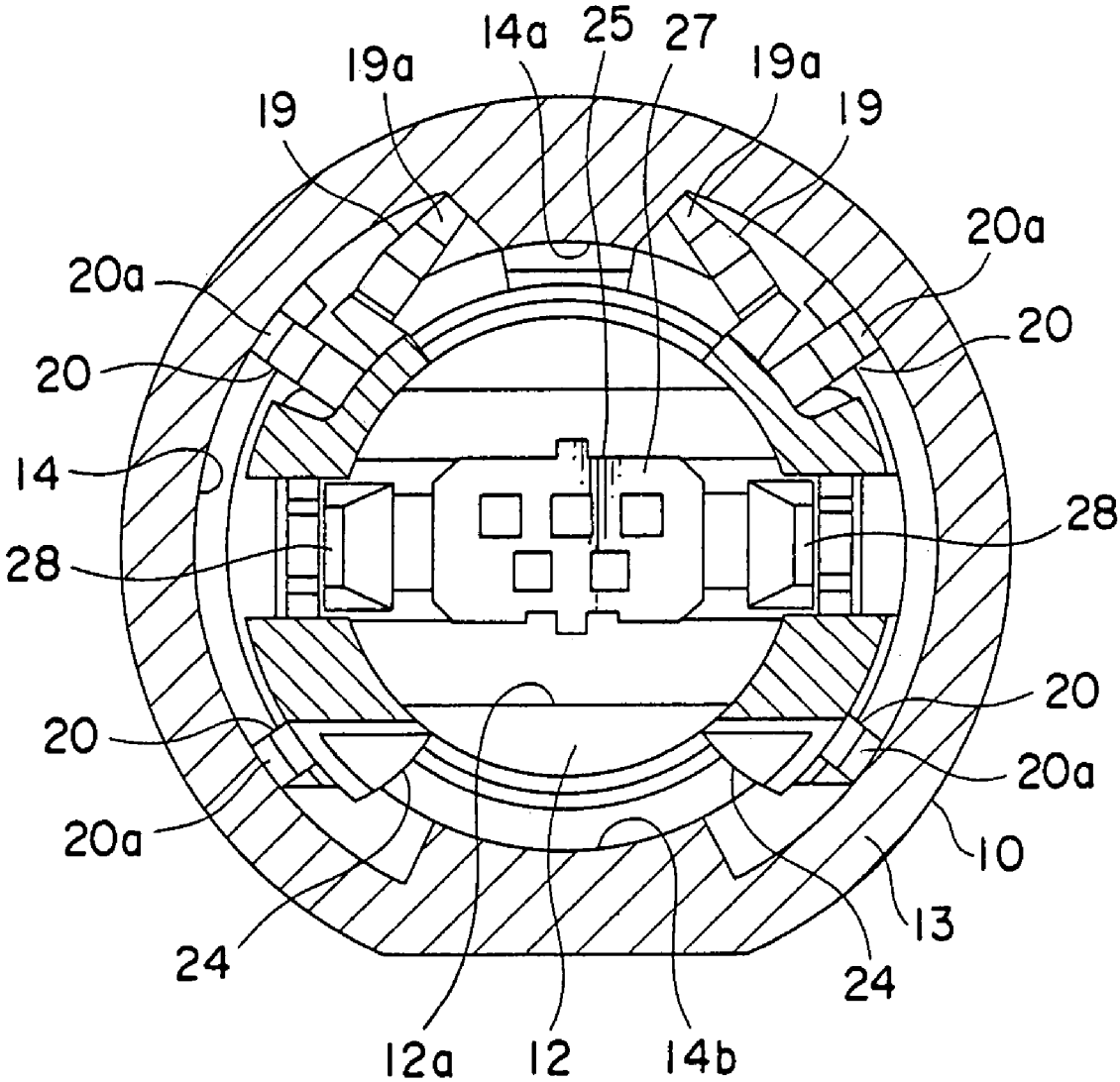
FIG. 6 is a sectional view taken along the line VI-VI in FIG. 5.

The bracket 2 is made of an insulation synthetic resin, and has a main body 8 of plate shape and a pair of receivers 9. The main body 8 connects the pair of receivers 9. The pair of receivers 9 spaces to each other, and is arranged in parallel. The receiver 9 has a receiving body 10 (corresponding to a receiving member) and a flange 11. As shown in FIG. 5 and FIG. 6, the receiving body 10 has a bottom plate 12 of a ring shape and a cylinder 13 projecting from an outer edge of the bottom plate 12 in one piece to be formed into a bottomed cylinder shape. The receiving body 10 receives the holder 3 inside thereof and holds the holder 3.

The flange 11 is formed into a plate shape, and extends radically along the outer surface of the cylinder 13 of the receiving body 10 from an outer edge, apart from the bottom plate 12, of the cylinder 13 of the receiving body 10. The flange 11 is arranged about half around the outer edge of the cylinder 13 of the receiving body 10, apart from the bottom plate 12. The flange 11 has a step 15 so as to increase a thickness of an outer area of the flange 11. In addition, a bolt hole 16 is arranged in an end side of the flange 11, near to the main body 8. A nut, a screw hole of which is in communication with the bolt hole 16, is buried in the end side of the flange 11.

As shown in FIG. 5, the bottom plate 12 has an opening 12*a* passing a connector 4 therethrough. When the connector 4 is received into the holder 3 received in the receiving body 10, the connector 4 is received in the holder 3 through the opening 12*a* of the bottom plate 12.

The cylinder 13 has a receiving hole 14 receiving the holder 3 therein. An inner diameter of the receiving hole 14 is formed larger than an outer diameter of the holder 3. When the receiving hole 14 receives the holder 3, the receiving hole 14 has a space between the holder 3 and itself. The receiving hole 14 has an abut rib 14*a* and a control rib 14*b*, both projecting from an inner surface of the receiving hole 14 in a radial direction. The abut rib 14*a* is opposed to the control rib 14*b* in the radial direction of the receiving hole 14. Therewith, the abut rib 14*a* is arranged in an area near the flange 11 of the inner surface of the receiving hole 14. The control rib 14*b* is arranged in an area apart from the flange 11 of the inner surface of the receiving hole 14.

The holder 3 is made of an insulation synthetic resin and formed into a cylindrical shape as a whole. As shown in FIG. 2, the holder 3 has a cylindrical holder body 17 and a flange 18 integrally. The holder body 17 is formed into a cylindrical shape as a whole, having a plurality of cutouts and holes. The holder body 17 is received in the receiving body 10.

As shown in FIG. 5 to FIG. 8, the holder body 17 has a first positioning arm 19, a second positioning arm 20, a holder lock arm 21 and a limiter 24. A pair of first positioning arms 19 is arranged in an area near the flange 18 of an outer surface of the holder body 17. The pair of first positioning arms 19 is formed into a bar shape elastically deformable. One end of the first positioning arm 19 continues to the holder body 17. A contact piece 19*a* is arranged at the other end of the first positioning arm 19. The contact pieces 19*a* project to make the pair of first positioning arms 19 close to each other. The contact piece 19*a* can be elastically deformed freely along the outer surface of the holder body 17 so as to make contact the contact pieces 19*a* close to and apart from each other.

When the holder body 17 is received in the receiving hole 14 of the receiving body 10, the contact piece 19*a* abuts on the abut rib 14*a* arranged in the inner surface of the receiving hole 14. When the holder body 17 is received in the receiving hole 14 of the cylinder 13 of the receiving body 10 and rotates in one direction about an axis of the cylinder 13, the contact piece 19*a* of the one first positioning arm 19 abuts on the abut rib 14*a* and is elastically deformed. Furthermore, when the holder body 17 is rotated in the other direction opposite to the one direction about the axis, the contact piece 19*a* of the other first positioning arm 19 abuts on the abut rib 14*a* and is elastically deformed.

The contact piece 19*a* abuts on the abut rib 14*a* of the inner surface of the receiving hole 14, and is elastically deformed. Thereby, the holder body 17 is supported movably around the axis in the receiving body 10, and always pushed around the axis in the receiving body 10.

The four second positioning arms 20 are arranged in FIGs. The second positioning arms 20 are arranged with a space in the circumferential direction of the holder 17. Therewith, the second positioning arm 20 projects from an outer surface of the holder body 17 in the outward direction. The plural second positioning arms 20 are formed into a bar shape elastically deformable. One end of the second positioning arm 20 continues to the holder body 17. A contact piece 20*a* is arranged at the other end of the second positioning arm 20, and deformed elastically freely so as to move close to and apart form the holder body 17. The contact piece 20*a* is formed projecting outwardly from an outer edge of the holder body 17.

Figure 8:
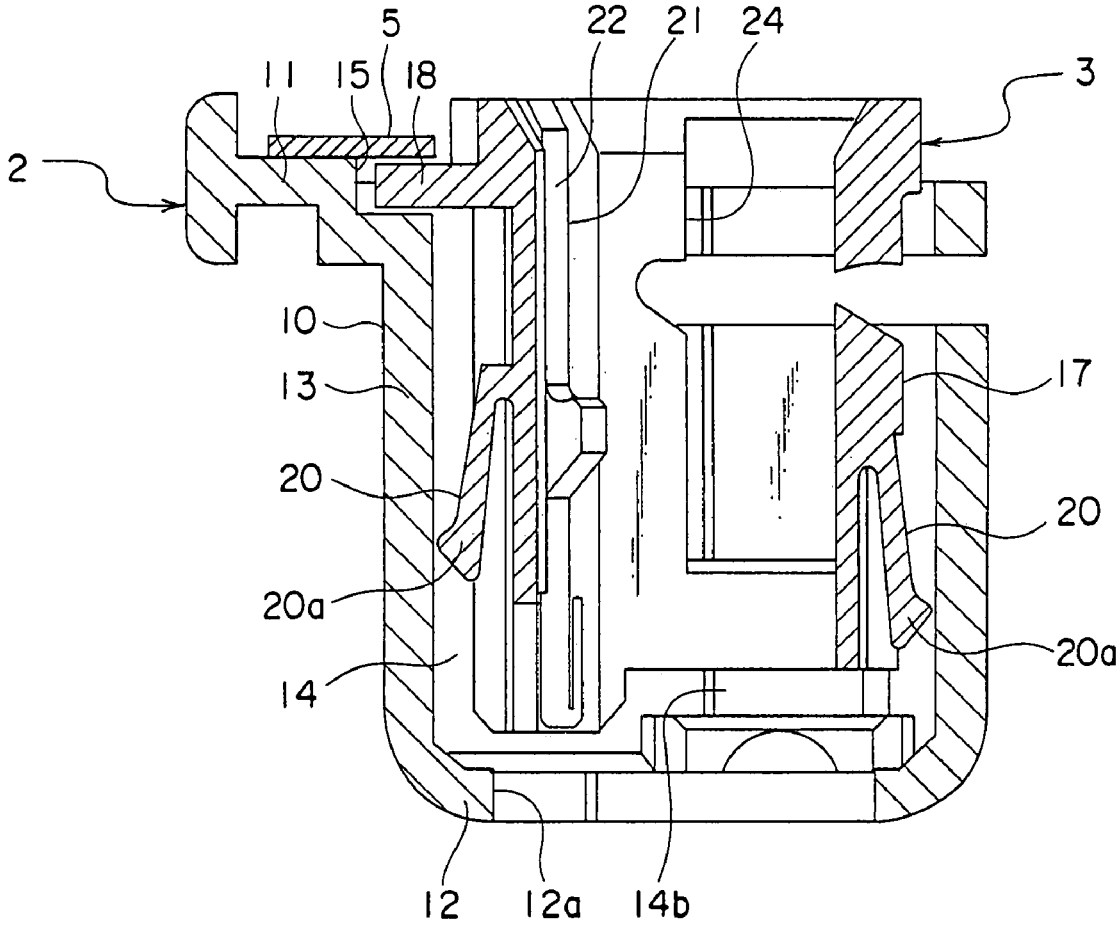
FIG. 8 is a sectional view taken along the line VIII-VIII in FIG. 4.

As shown in FIG. 8, when the holder body 17 is received in the receiving hole 14 of the receiving body 10, the contact pieces 20*a* abut on the inner surface of the receiving hole 14. The contact piece 20*a* abuts on the inner surface of the receiving hole 14 and is deformed elastically. Thereby, the second positioning arms 20 support movably the holder 17 in the radial direction in the receiving hole 14 of the receiving body 10, and always push it toward the center of the receiving body 10.

As shown in FIG. 2 or FIG. 6, a pair of the limiters 24 is arranged at a side surface of the holder body 17, apart from the flange 18. The pair of the limiters 24 is an inner edge of a cutout arranged in the holder body 17. Furthermore, the pair of the limiters 24 is arranged in a position corresponding to the pair of the first positioning arms 19 opposite thereto about the center of the holder body 17 so as to correspond to each other along the outer surface of the holder body 17. When the holder body 17 is received in the receiving hole 14 of the receiving body 10, and rotated a predetermined angle in the one direction about the axis, one of the pair of limiters 24 abuts on the control rib 14*b* arranged in the inner surface of the receiving hole 14. In addition, when the holder body 17 is rotated a predetermined angle in the other direction opposite to the one direction about the axis, the other of the limiters 24 abuts on the control rib 14*b*.

When the holder body 17 is rotated a predetermined angle about the axis in the receiving hole 14 of the receiving body 10, the pair of the limiters 24 abuts respectively on the control rib 14*b* arranged in the inner surface of the receiving hole 14. Thereby, the rotation angle of the holder 3 around the axis in the receiving body 10 is controlled.

As shown in FIGs, a holder lock arm 21 is arranged in one pair. A pair of the holder lock arms 21 is arranged in positions opposite to each other about the center of the holder body 17. As shown in FIG. 2 and FIG. 6, the holder lock arm 21 has an arm body 22 of a bar shape and a lock projection 23. A lengthwise of the arm body 22 is arranged along the axis of the holder body 17. Both ends of the lengthwise of the arm body 22 are formed continuous to the holder body 17. Portions other than the both ends of the arm body 22 are arranged not continuous to the holder body 17, and formed into a both-end-supported beam shape. The lock projection 23 is arranged in the center of a lengthwise of the arm body 22, and formed projectingly so as to make the holder lock arms 21 near to each other from the arm body 22.

The flange 18 is formed into a plate shape. When the holder body 17 is received in the receiving body 10, the flange 18 extends from one end of the holder 17 near the flange 11 along the outer surface of the holder body 17. The flange 18 is arranged approximately half around the one end of the holder body 17.

In the above mentioned holder 3, the flange 18 is overlapped on the flange 11 of the receiver 9, and the holder body 17 is received in the receiving body 10 of the receiver 9. Also, the flange 18 of the holder 3 is positioned in an inner side of the step 15 of the receiver 9. The holder 3 receives a connector 4 in the holder body 17, and a later-described lock arm 28 of the connector 4 is engaged with the holder lock arm 21. Thereby the holder 3 holds the connector 4.

Figure 3:
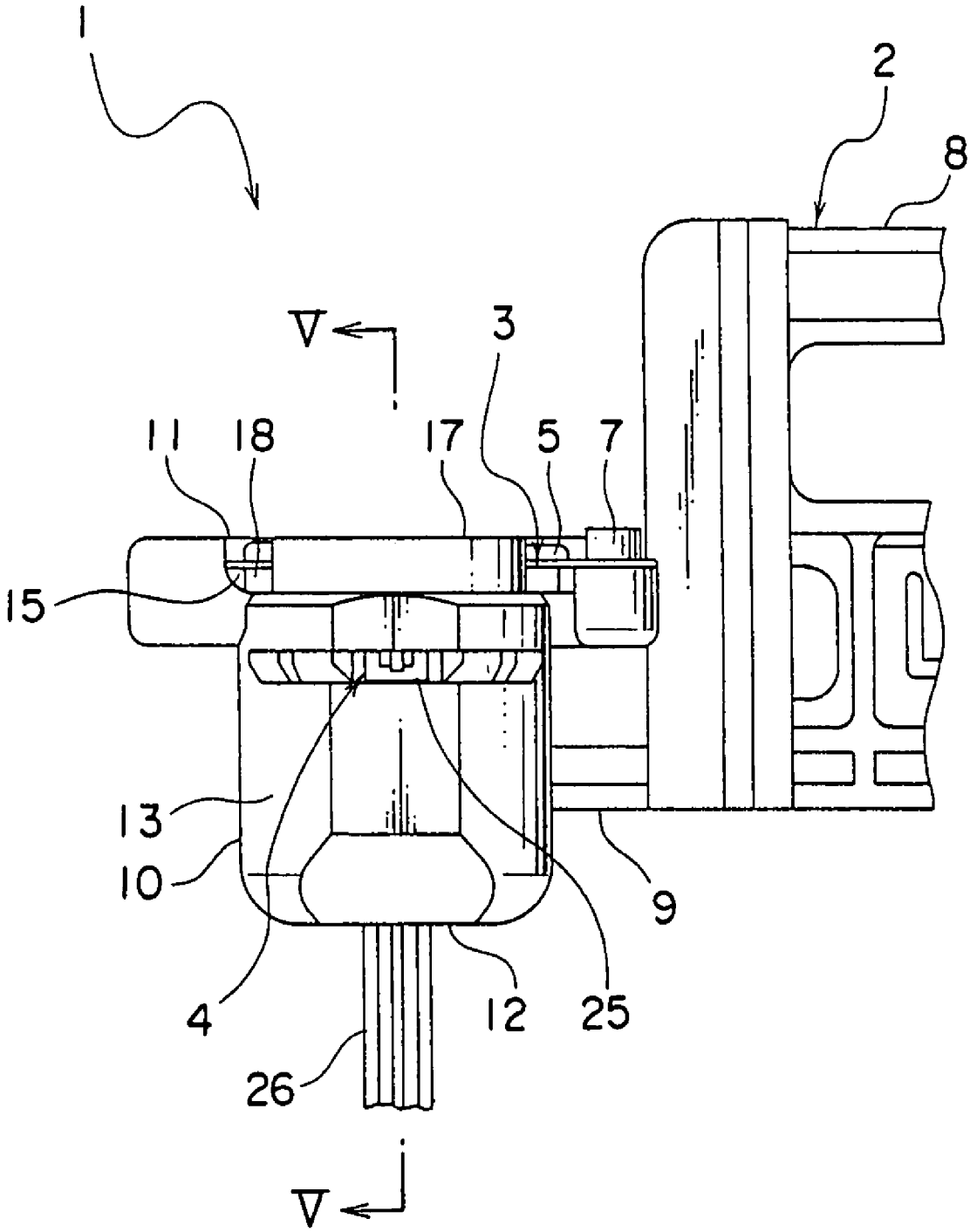
FIG. 3 is a front view of the connecting mechanism for a connector of FIG. 1.

As shown in FIG. 2 and FIG. 3, the connector 4 has a terminal (not shown) and a connector housing 25. The terminal is made of the conductive metal plate. The terminal is joined with an end of an electric wire 26, thereby electrically connected with a core of the electric wire 26.

The connector housing 25 is made of the insulation synthetic resin, and has a housing body 27 of box shape and a lock arm 28. The housing body 27 is provided with a plurality of terminal receiving sections. The each terminal receiving section extends linearly. The plurality of terminal receiving sections is arranged in parallel to each other. The terminal receiving section is a hole (space), both ends of which open at an outer surface of the housing body 27.

The connector housing 25 has two lock arms 28. The two lock arms 28 position the housing body 27 therebetween. Each lock arm 28 is formed into a band plate shape and arranged in parallel to the terminal receiving section. The lock arm 28 is formed into a cantilever shape so that one end portion of the lock arm 28 apart from a mating connector (not shown) is continued to the housing body 27. The other end of the lock arm 28 engages with the lock projection 23 of the holder lock arm 21 and a lock projection of the mating connector (not shown).

The above mentioned connector 4 is inserted from an opening 12*a* arranged in a bottom plate 12 apart from the flange 11 into the holder body 17 and received in the holder body 17. The other end portion of the lock arm 28 of the connector 4 is engaged with the lock projection 23, and the connector 4 is held in the holder body 17 of the holder 3. The connector 4 is inserted into the holder body 17 of the holder 3 along an arrow S in parallel to the lengthwise direction of the terminal receiving section and the axis of the holder body 17. The arrow S shows an insertion direction of the connector 4 to the holder body 17 of the holder 3.

The plate 5 is made of a thick metal plate, and formed into a flat plate shape. One end portion of the plate 5 is arranged with a locking portion locking in the flange 11 of the receiver 9, and the other end portion of the plate 5 is arranged with a bolt hole 6, through which a bolt 7 is passed. In state of the locking portion of the plate 5 is locked in the flange 11 of the receiver 9, the plate 5 is overlapped in the flange 11. Therewith, the bolt hole 6 of the plate 5 is communicated with the bolt hole 16 arranged in the flange 11 of the receiver 9.

The plate 5 nips the flange 18 of the holder 3 between the flange 11 of the receiver 9 and itself. The plate 5 is mounted on the flange 11 of the receiver 9 by screwing the bolt 7 into the nut through the bolt holes 6, 16. The plate 5 nips the flange 18 of the holder 3 between the flange 11 of the receiver 9 and itself, and fixes the holder 3 in the receiver 9.

Figure 4:
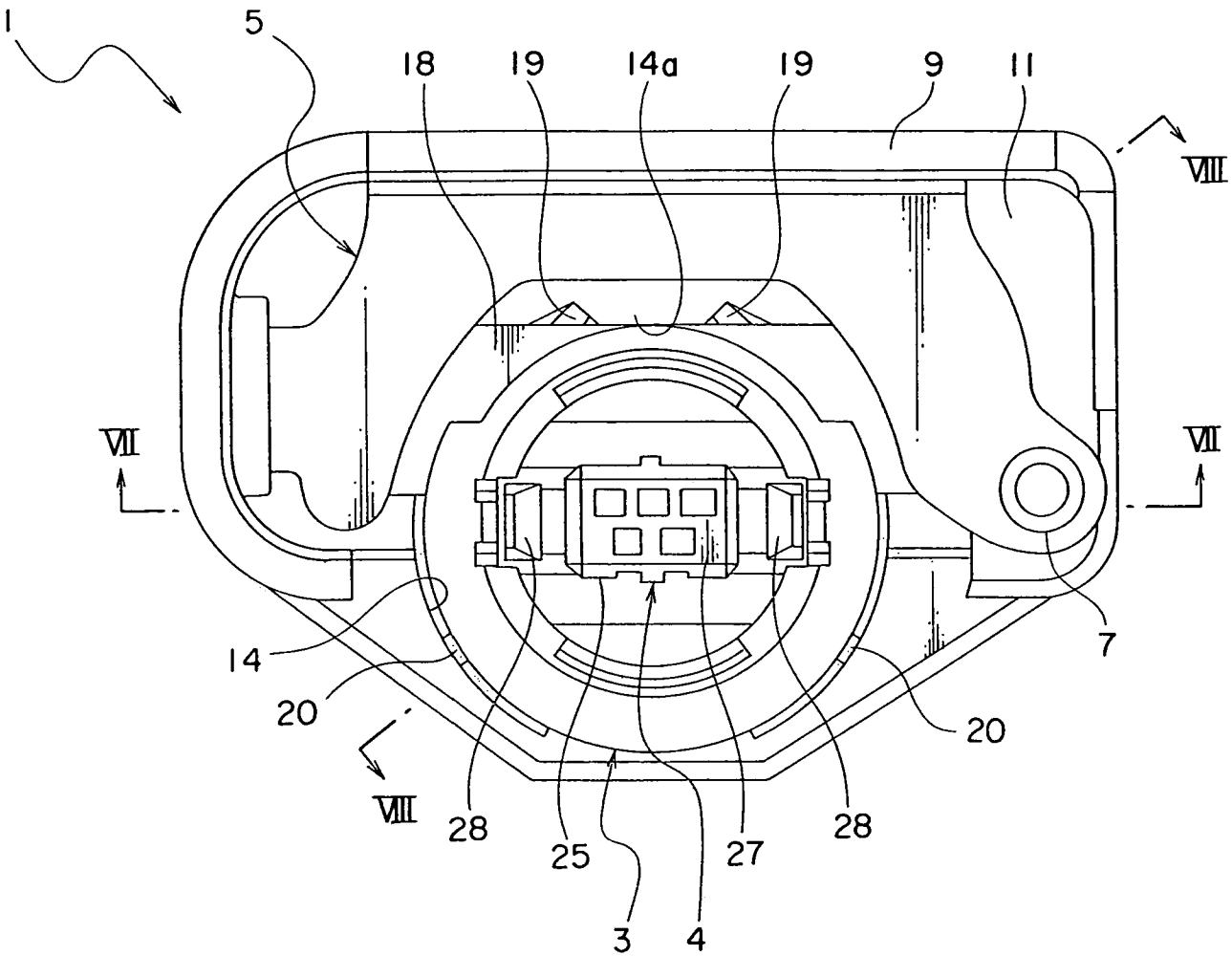
FIG. 4 is a plan view of a receiver of the connecting mechanism for a connector of FIG. 1.
Figure 7:
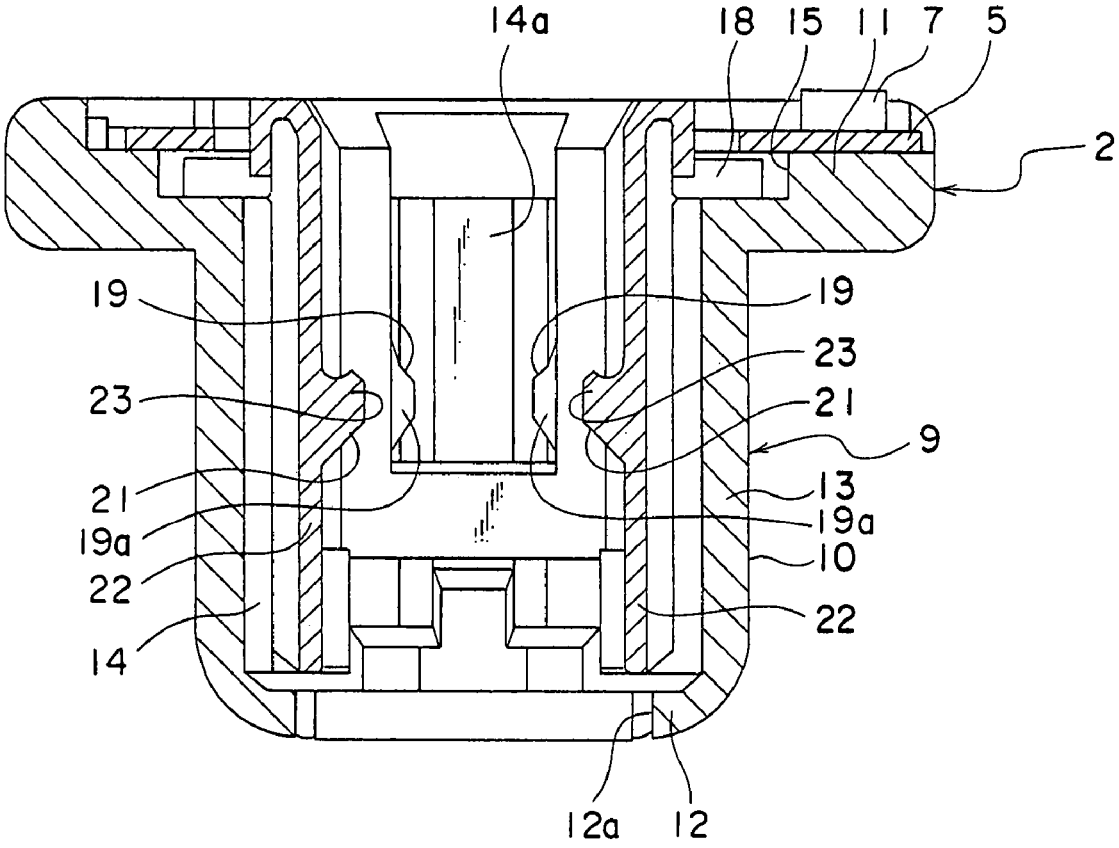
FIG. 7 is a sectional view taken along the line VII-VII in FIG. 4.

The above mentioned connecting structure 1 is assembled as a below. As shown in FIG. 7 and FIG. 8, the holder body 17 is inserted into the receiving hole 14 of the receiving body 10, therewith the flange 18 is overlapped on the flange 11, and the holder 3 is held in the receiving body 10 of the receiver 9. As shown in FIG. 4, the plate 5 is overlapped on the flange 18 of the holder 3 and fixed in the flange 11 of the receiver 9 by the bolt 7. Thereafter, the connector 4 is placed with a space against the opening 12*a* arranged in the bottom plate 12. Furthermore, the connector 4 is inserted into the holder body 17 of the holder 3. As shown in FIG. 3 to FIG. 5, the connector 4 is held in the holder body 17. Thus, the above mentioned connecting structure 1 is assembled.

Therefore, both contact pieces 19*a* of the pair of first positioning arms 19 arranged in the holder body 17 of the holder 3 abut on the abut rib 14*a* arranged in the receiver hole 14 of the receiving body 10. Thereby, the holder 3 is positioned in a rotating direction around the axis in the receiver body 10. Therewith, the contact pieces 20*a* of the plurality of second positioning arms 20 arranged in the holder body 17 abut on the inner surface of the receiving hole 14, thereby the holder 3 is positioned in the radial direction of the receiving hole 14 in the receiving hole 10.

Furthermore, the limiter 24 of the holder body 17 abuts on the control rib 14*b* arranged in the receiving hole 14 of the receiving body 10. Thereby, the rotation angle of the holder 3 in the receiving body 10 around the axis is controlled.

The above mentioned connector 4 of the connecting structure 1 fits in the mating connector mounted in ahead rest (not shown). The mating connector has a terminal (not shown) and a connector housing made of an insulation synthetic resin. The terminal is joined with an end of the electric wire connected with the electric equipment, for example the above mentioned monitor and the whiplash protecting device, and connected with the core of the electric wire. The connector housing has a plurality of terminal receiving sections receiving the above mentioned terminal, and a lock projection projecting from an outer surface thereof for engaging with the lock arm 28 of the connector 4. The lock projection of the mating connector is engaged with the lock arm 28 and the mating connector fits in the connector 4.

The bracket 2 of the above mentioned connecting structure 1 is fixed on a seat, and the connecting structure 1 is mounted on the seat. The head rest is approached to the seat and the mating connector mounted in the head rest is approached to the connector 4, thereby the mating connector is fit in the connector 4. As a result, the connecting structure 1 connects the electric equipment of the vehicle body with the electric equipment to be mounted head rest, and provides a desired electric power and signal to the electric equipment to be mounted head rest.

According to embodiments of the present invention, the contact pieces 19*a* of the pair of first positioning arms 19 arranged in the holder body 17 of the holder 3 abut on the abut rib 14*a* arranged in the receiving hole 14 of the receiving body 10, thereby the holder 3 is supported movably around the axis in the receiving hole 14 of the receiving body 10 and pushed in the rotating direction around the axis. For this reason, the connector 4 can be aligned and positioned in the rotating direction in the receiving body 10. Therefore, the connector 4 can be aligned in the rotating direction against the mating connector and fit smoothly therewith.

The contact pieces 20*a* of the plurality of second positioning arms 20 arranged in the holder body 17 abut on the inner surface of the receiving hole 14, thereby the holder 3 is supported movably in the rotating direction in the receiving hole 14 of the receiving body 10 and always pushed toward the center of the receiving body 10. For this reason, the connector 4 can be aligned and positioned in the rotating direction in the receiving body 10. Therefore, the connector 4 can be aligned against the mating connector and fit smoothly therewith.

Also the pair of limiters 24 arranged in the holder body 17 of the holder 3 abut on the control rib 14*b* arranged in the receiving hole 14 of the receiving body 10. Thereby, the holder 3 is controlled about the rotation angle in the rotating direction around the axis in the receiving hole 14. For this reason, movement in the rotating direction of the holder 3 is controlled in the necessary prescribed angle around the axis in the receiving hole 10, thereby unnecessary rotation of the holder 3 can be limited. Therefore, the connector 4 can be aligned against the mating connector smoothly.

According to the above mentioned embodiment, the connecting structure 1 mounted on the sheet is shown so as to send the desired electric power and signal to the electric equipment mounted in the headrest. However, the preset invention does not limit it, but allows to send the desired electric power and signal to electric equipment to be mounted on an object other than the sheet and the headrest (may be other than the vehicle).

While the invention has been described with reference to specific embodiments, the description is illustrative and not to be construed as limiting the scope of the invention. That is to say, various changes and modifications can be made without departing from the scope of the invention as defined by the following claims.

While, in the embodiment, the present invention is described, it is not limited thereto. Various change and modifications can be made with the scope of the present invention.

What is claimed is:

1. A connecting mechanism for a connector comprising:

a holder receiving a connector therein and holding the connector;

a receiving member receiving the holder therein and holding the holder; and a fixing member attached at the receiving member and fixing the holder, wherein an inner diameter of the receiving member is formed larger than an outer diameter of the holder, and the receiving member comprises a receiving hole having a gap between the holder and itself when the holder is received, and an abut rib projected from an inner surface of the receiving hole, wherein the holder comprises a first positioning arm, which positions the holder in a rotating direction around an axis of the holder with respect to the receiving member by rotating the holder around the axis in the receiving hole so as to make the first positioning arm abut on the abut rib and press the first positioning arm on the abut rib when the holder is received in the receiving hole and mounted in the receiving member.

2. The connecting mechanism according to claim 1, wherein the receiving member comprises a control rib projecting from the inner surface of the receiving hole and corresponding to the abut rib, and the holder comprises a limiter controlling a rotation angle of the holder around the axis by abutting on the control rib when the holder is rotated a prescribed angle in the rotating direction around the axis of the holder in the receiving hole.

3. The connecting mechanism according to claim 1, wherein a pair of the first positioning arms projects from an outer surface of the holder in a outward direction to be elastically deformable, and when the holder is rotated in one rotating direction around the axis in the receiving hole, one of the first positioning arms abuts on the abut rib, and when the holder is rotated in the other direction opposite to the one direction, the other of the first positioning arms abuts on the abut rib.

4. The connecting mechanism according to claim 3, wherein the receiving member comprises a control rib projecting from the inner surface of the receiving hole and corresponding to the abut rib, and the holder comprises a limiter controlling a rotation angle of the holder around the axis by abutting on the control rib when the holder is rotated a prescribed angle in the rotating direction around the axis of the holder in the receiving hole.

5. The connecting mechanism according to claim 1, wherein the holder comprises a second positioning arm, which positions the holder with respect to the receiving member in a radial direction of the receiving hole by abutting on the inner surface of the receiving hole and pressing the inner surface in the radial direction when the holder is received in the receiving hole and mounted to the receiving member.

6. The connecting mechanism according to claim 5, wherein the receiving member comprises a control rib projecting from the inner surface of the receiving hole and corresponding to the abut rib, and the holder comprises a limiter controlling a rotation angle of the holder around the axis by abutting on the control rib when the holder is rotated a prescribed angle in the rotating direction around the axis of the holder in the receiving hole.

7. The connecting mechanism according to claim 3, wherein the holder comprises a second positioning arm, which positions the holder with respect to the receiving member in a radial direction of the receiving hole by abutting on the inner surface of the receiving hole and pressing the inner surface in the radial direction when the holder is received in the receiving hole and mounted to the receiving member.

8. The connecting mechanism according to claim 7, wherein the receiving member comprises a control rib projecting from the inner surface of the receiving hole and corresponding to the abut rib, and the holder comprises a limiter controlling a rotation angle of the holder around the axis by abutting on the control rib when the holder is rotated a prescribed angle in the rotating direction around the axis of the holder in the receiving hole.

9. The connecting mechanism according to claim 5, wherein a plural of the second positioning arms projects from the outer surface of the holder in the outward direction, and is spaced in a circumferential direction of the receiving hole, and is formed elastically deformable in the radial direction so as to abut on the inner surface of the receiving hole when the holder is moved in the radial direction within the receiving hole.

10. The connecting mechanism according to claim 9, wherein the receiving member comprises a control rib projecting from the inner surface of the receiving hole and corresponding to the abut rib, and the holder comprises a limiter controlling a rotation angle of the holder around the axis by abutting on the control rib when the holder is rotated a prescribed angle in the rotating direction around the axis of the holder in the receiving hole.

11. The connecting mechanism according to claim 7, wherein a plural of the second positioning arms projects from the outer surface of the holder in the outward direction, and is spaced in a circumferential direction of the receiving hole, and is formed elastically deformable in the radial direction so as to abut on the inner surface of the receiving hole when the holder is moved in the radial direction within the receiving hole.

12. The connecting mechanism according to claim 11, wherein the receiving member comprises a control rib projecting from the inner surface of the receiving hole and corresponding to the abut rib, and the holder comprises a limiter controlling a rotation angle of the holder around the axis by abutting on the control rib when the holder is rotated a prescribed angle in the rotating direction around the axis of the holder in the receiving hole.

* * * * *